US011122899B2

(12) United States Patent
Scarlett

(10) Patent No.: US 11,122,899 B2
(45) Date of Patent: Sep. 21, 2021

(54) SEAT FOR USERS WITH POSTURAL CARE REQUIREMENTS

(71) Applicant: ROLAPAL LIMITED, Auckland (NZ)

(72) Inventor: Roydon Mark Scarlett, Auckland (NZ)

(73) Assignee: ROLAPAL LIMITED, Auckland (NZ)

( * ) Notice: Subject to any disclaimer, the term of this patent is extended or adjusted under 35 U.S.C. 154(b) by 0 days.

(21) Appl. No.: 16/601,795

(22) Filed: Oct. 15, 2019

(65) Prior Publication Data

US 2021/0106139 A1 Apr. 15, 2021

(51) Int. Cl.

| | |
|---|---|
| ***A47C 1/03*** | (2006.01) |
| ***A47C 1/032*** | (2006.01) |
| ***A61G 5/12*** | (2006.01) |
| ***A61G 5/10*** | (2006.01) |

(52) U.S. Cl.

CPC ..... *A47C 1/03294* (2013.01); *A61G 5/1067* (2013.01); *A61G 5/1075* (2013.01); *A61G 5/122* (2016.11)

(58) Field of Classification Search

CPC ..... A47C 1/03294; A47C 1/032; A47C 1/031; A61G 5/122; A61G 5/1067; A61G 5/1075

USPC ..... 297/354.1, 354.12

See application file for complete search history.

(56) References Cited

U.S. PATENT DOCUMENTS

| | | | | | |
|---|---|---|---|---|---|
| 3,315,884 | A * | 4/1967 | Bennett | G06C 7/06 | 235/60 R |
| 4,131,316 | A * | 12/1978 | Pallant | B60N 2/12 | 297/341 |
| 4,709,965 | A * | 12/1987 | Kazaoka | B60N 2/235 | 297/340 |
| 4,861,106 | A * | 8/1989 | Sondergeld | A47C 1/03238 | 297/316 |
| 6,588,843 | B1 * | 7/2003 | Ebenstein | A47C 1/03255 | 297/300.1 |
| 2004/0188979 | A1 * | 9/2004 | Bernatsky | A61G 5/1075 | 280/304.1 |
| 2005/0040626 | A1 * | 2/2005 | Papac | A61G 5/12 | 280/647 |
| 2005/0116440 | A1 * | 6/2005 | Bernatsky | A61G 5/1075 | 280/250.1 |
| 2009/0315379 | A1 * | 12/2009 | Jacobs | A47D 1/004 | 297/344.18 |
| 2012/0146301 | A1 * | 6/2012 | Horvath | A61G 5/1075 | 280/47.4 |
| 2017/0112289 | A1 * | 4/2017 | Wickett | A47C 7/58 | |
| 2019/0167498 | A1 * | 6/2019 | Parker | A61G 5/08 | |

* cited by examiner

*Primary Examiner* — Mark R Wendell
(74) *Attorney, Agent, or Firm* — Daniel A. Thomson; Emerson, Thomson, Bennett, LLC

(57) ABSTRACT

A seat is disclosed herein having a backrest, a base for receiving a posterior of a human user, and an incline adjuster having a shaft, a lever, a follower, and a rack the shaft being moveable to swing the lever to cause a follower into or out of locking engagement with the rack, an arrangement being such that when the follower is in an unlocked disposition the rack can move to adjust an incline of the backrest and the base.

14 Claims, 4 Drawing Sheets

SEAT FOR USERS WITH POSTURAL CARE REQUIREMENTS

FIELD

This present teaching relates to a seat, for example for users with postural care requirements.

BACKGROUND

It is known to provide seating for disabled users with specific postural care requirements where the incline of a seat is adjustable. The incline of some existing seats can be adjusted by way of a cable arrangement. It is a problem in that cables may be exposed and can become stretched or otherwise damaged and need maintenance or replacement.

It is an object of one aspect of the present teachings to go at least some way towards addressing this problem. It should be understood that the object of the present teaching per se is not so limited and is simply to provide a useful choice. Any objects and advantages of this aspect should not be seen as limitations on claims that do not mention them.

The term "comprising" and derivatives thereof, e.g. "comprises," if and when used herein in relation to a combination of features should not be taken as excluding the possibility that the combination may have further unspecified features. For example, a statement that an arrangement "comprises" certain parts does not mean that it cannot also, optionally, have additional parts.

SUMMARY

According to one aspect of the present teaching, there is provided a seat having:

a backrest;

a base for receiving the posterior of a human user; and an incline adjuster having:

a shaft;

a lever;

a follower; and a rack the shaft being moveable to swing the lever to cause the follower into or out of locking engagement with the rack, the arrangement being such that when the follower is in the unlocked disposition the rack can move to adjust the incline of the backrest and base.

Optionally, the incline adjuster is at one side of the seat and there is a second substantially similar incline adjuster at the opposite side of the seat, the adjusters being linked so that moving force transfers from one to the other so that they move in unison.

Optionally, the seat has a chassis base and a tilt rail, the base and rail being combined by a link such that the rail can be moved forwards and backwards with respect to the base by way of rollers.

Optionally, the lever pivots on the link.

Optionally, there is a second lever which also pivots on the link and serves to assist movement of the follower with respect to the rack.

Optionally, the tilt rail has at least one track which receives the rollers.

Optionally, the tilt rail is curved.

Optionally, the rack is curved.

Optionally, the follower has teeth which are adapted to engage complimentary teeth of the rack in locking relationship.

Optionally, the follower extends into an aperture in the tilt rail when the follower is in locking engagement with the rack.

Optionally, the follower does not extend into the aperture in the tilt rail when the follower is out of locking engagement with the rack so that the rollers are able to move along the track.

Optionally, a spring is able to be compressed to hold the follower out of locking engagement with the rack.

Optionally, pressure on the spring is able to be released to move the follower into locking engagement with the rack.

Optionally, the shaft, follower and rack are substantially enclosed.

Optionally, movement of the shaft is activated by a foot pedal.

According to a further aspect of the present teaching, there is provided seat having:

a backrest;

a base for receiving the posterior of a human user;

an incline adjuster; and a support the adjuster being adapted to adjust the incline of the backrest and base with respect to the support wherein the adjuster is substantially enclosed within at least one housing.

Still other benefits and advantages of the present subject matter will become apparent to those skilled in the art to which it pertains upon a reading and understanding of the following detailed specification.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DETAILED DESCRIPTION

Figure 1:
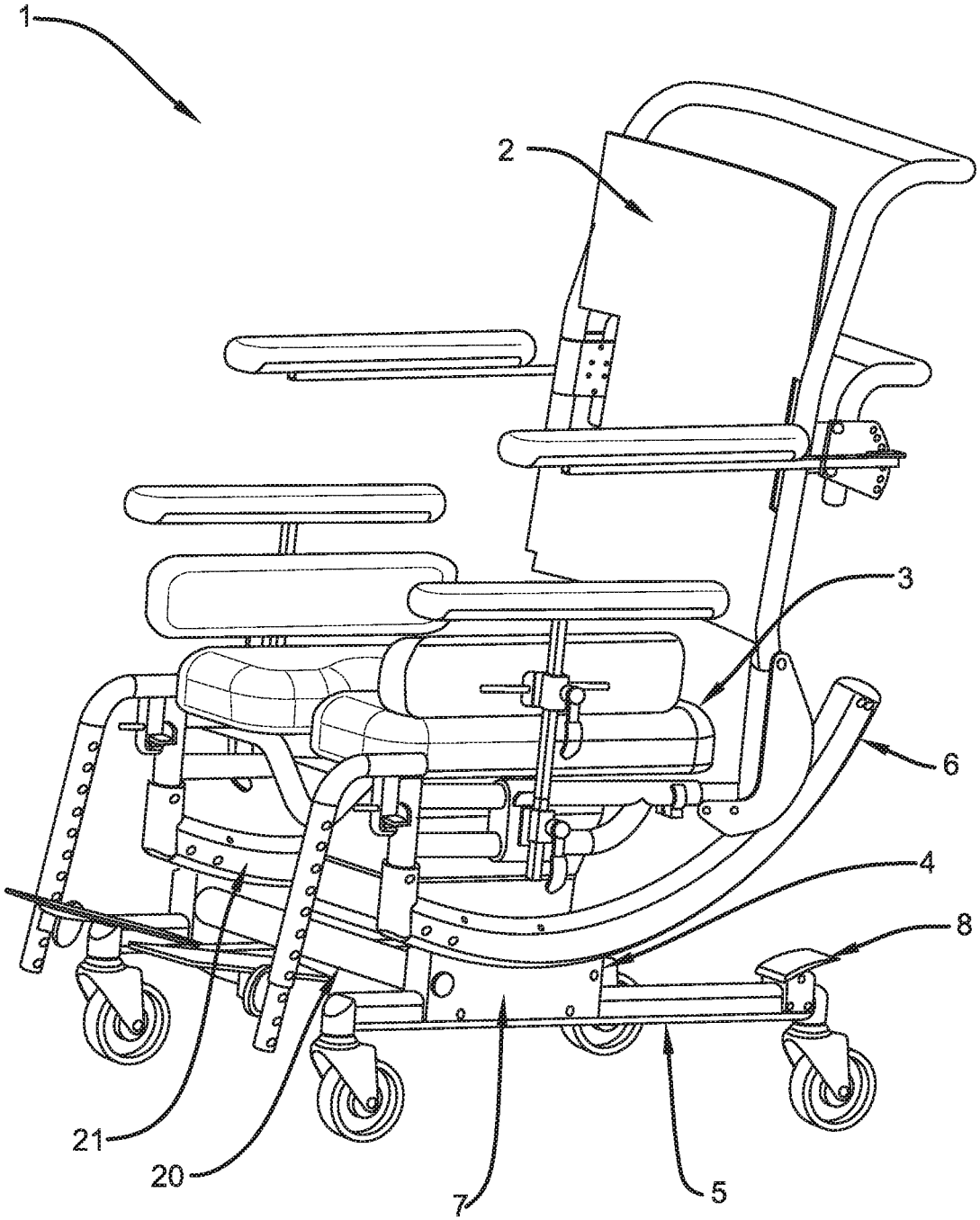
FIG. 1 is a perspective view of a seat.

Referring to FIG. 1, in one aspect of the present teaching, a seat 1 comprises a backrest 2, a base 3 for a user to sit on, and an incline adjuster 4. In this aspect the seat 1 is a commode but it should be appreciated that the present teaching may take different forms, for example a wheelchair or other form of disability seating.

Figure 2:
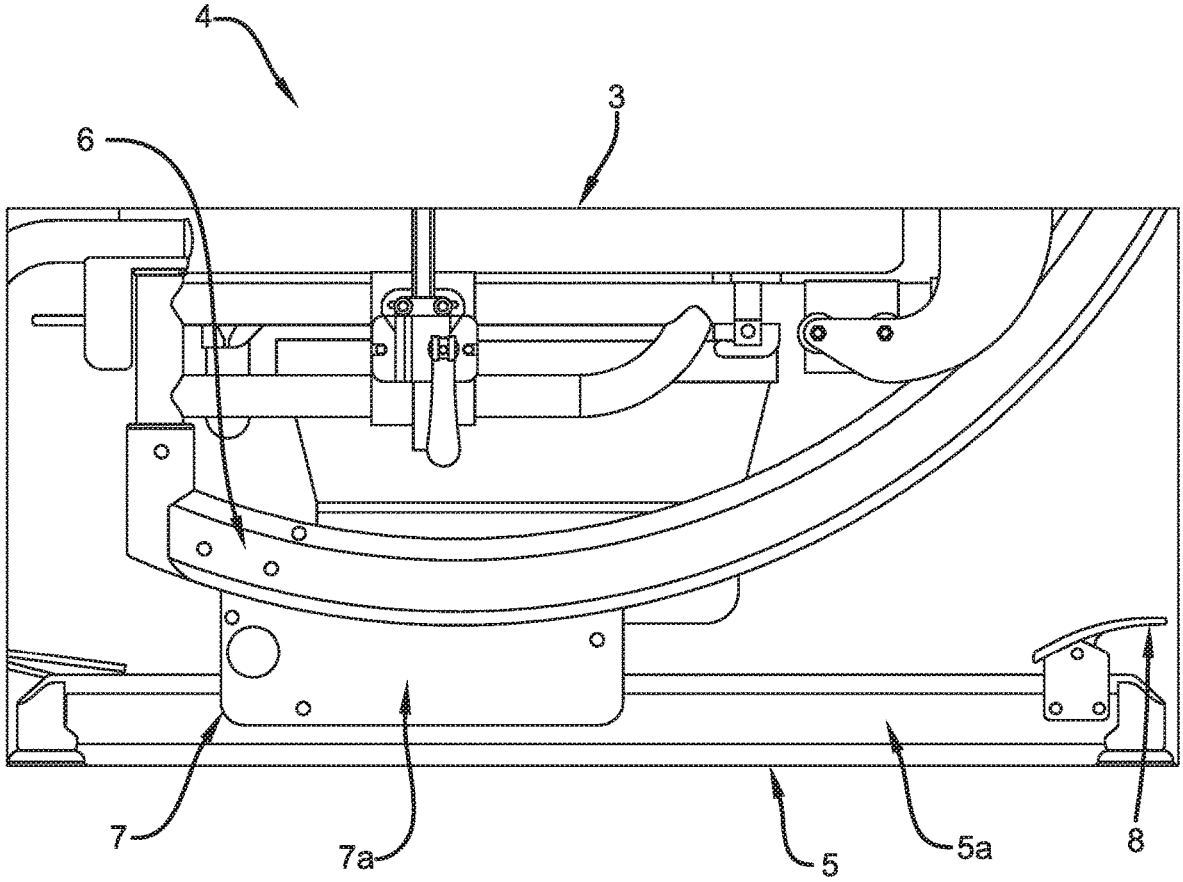
FIG. 2 is a side view of an angle adjuster.
Figure 3:
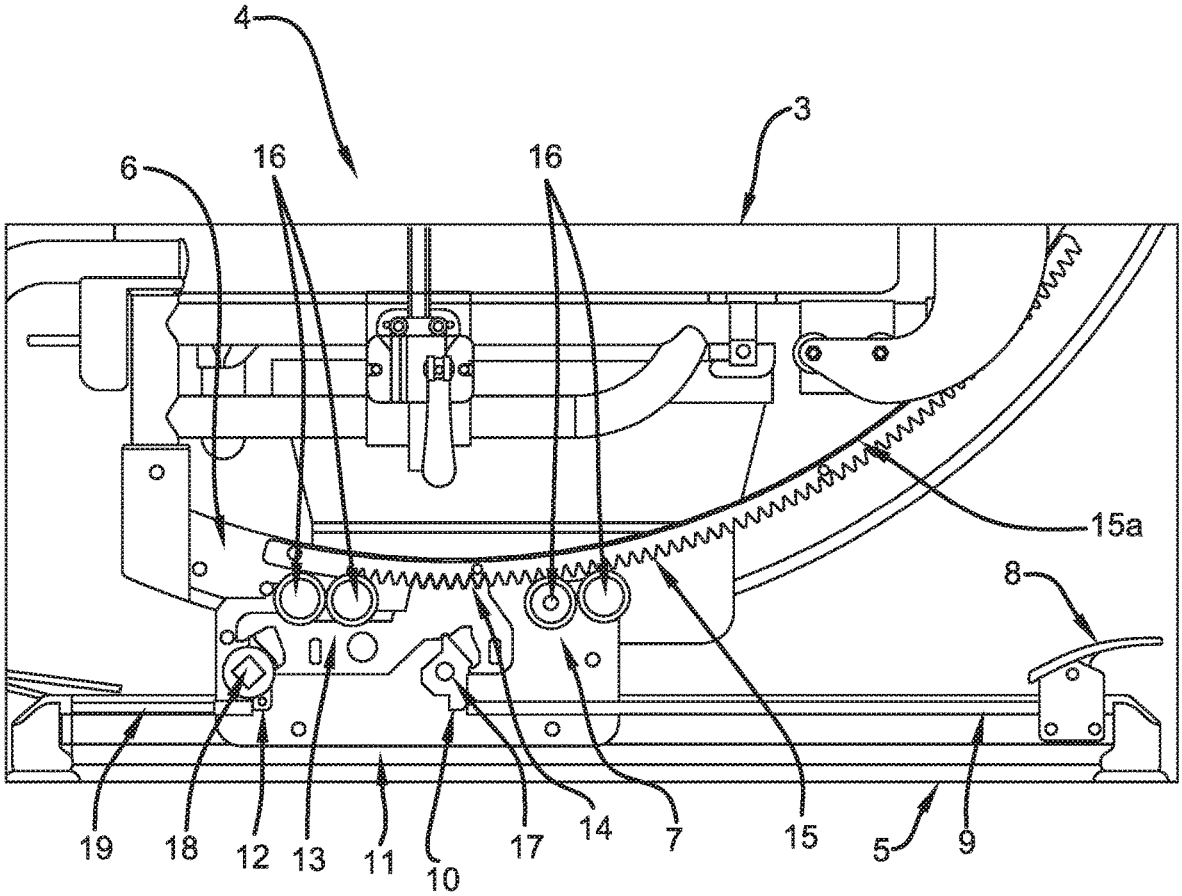
FIG. 3 is a partially cut away side view of the angle adjuster.

Referring to FIGS. 2 and 3, the incline adjuster 4 comprises a support or chassis base 5, a tilt rail 6, a castor mount 7, and a foot-operated tilt pedal 8. The pedal 8 is connected to a tilt rod 9 which abuts a lever or tilt lock cam 10. A tilt connector rod (not shown in FIG. 3) is positioned in a space 11 between the cam 10 and a second lever or tilt lock cam 12.

Each cam 10, 12 is in contact with a tilt lock follower 13. The tilt rail 6 is curved and tubular and comprises a curved rack 15*a* enclosed within the rail 6. The follower 13 has a plurality of teeth 14 which mesh with corresponding teeth 15 of the rack 15*a*.

The mount 7 is positioned on the chassis base 5 and comprises four pairs of castors or rollers 16 situated at the top of the mount 7.

When the teeth 14 of the follower 13 are engaged with the teeth 15 of the rack 15*a*, the adjuster 4 is in a locked disposition. The rail 6 cannot move and the backrest 2 and base 3, which are connected to the rail 6, are in a fixed position.

To adjust the angle of the backrest 2 and base 3, the user steps on the pedal 8 which causes the rod 9 to move from right to left. The rod 9 pushes against a lower part of the cam 10 which causes the cam 10 to move clockwise about a pivot point 17. The upper part of the cam 10 engages the follower 13 as it turns.

The movement of the rod 9 also moves the connector rod (not shown) into the second cam 12 which causes that cam 12 to also move clockwise about a second pivot point 18 into a further part of the follower 13. The connector rod compresses a pedal spring 19 which remains under pressure while the pedal 8 is depressed.

As the cams 10, 12 turn clockwise they move the follower 13 down so that the teeth 14 disengage from the rack teeth 15. The rail 6 is now free to run along the rollers 16 from left to right, or right to left.

When unlocked, the user can move the rail 6 manually to adjust the degree of incline of the backrest 2 and base 3. When the desired angle is reached the user steps off the pedal 8 releasing the pressure on the spring 19. This moves the connector rod and the rod 9 from left to right and turns the cams 10,12 counter-clockwise so that the teeth 14 reengage with the teeth 15, locking the rail 6 with respect to the mount 7.

A cross member or bar 20, as can be seen in FIG. 1, passes through the second pivot point 18 to connect with a second incline adjuster. The second adjuster comprises a second similar or identical castor mount and locking mechanism (not shown in FIG. 1) and a second tilt rail 21 on the other side of the seat 1. When the adjuster 4 is operated, the second adjuster moves in unison with it.

Figure 4:
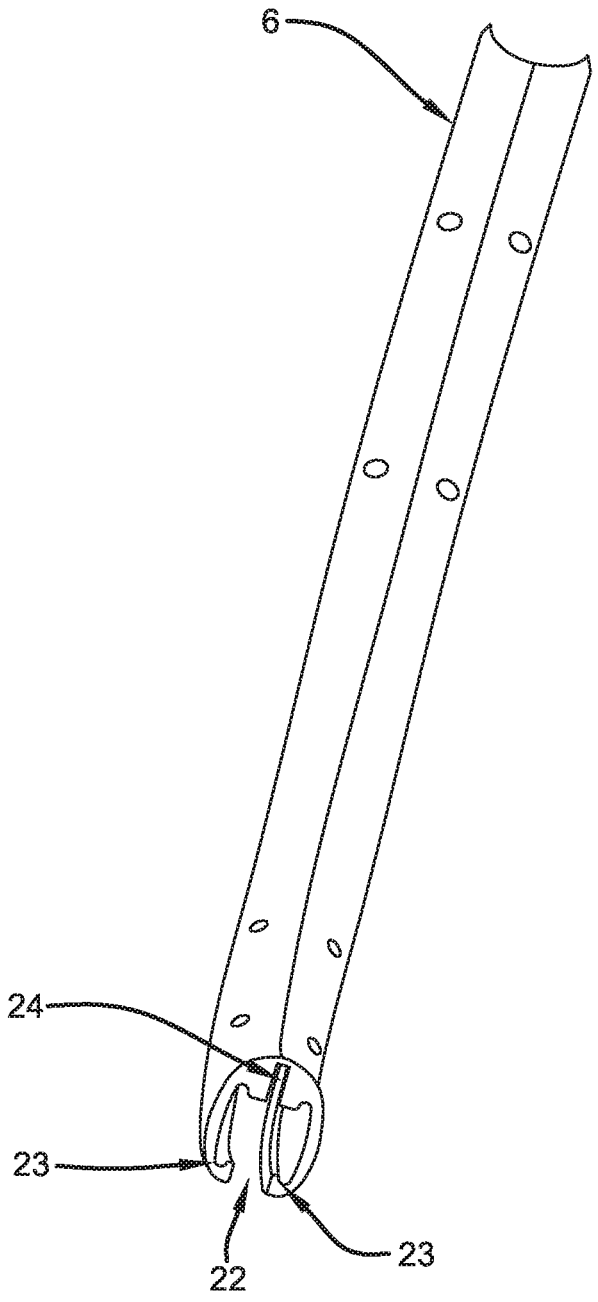
FIG. 4 is a perspective view of a tilt rail.

FIG. 4 shows a cross section of the rail 6 without the rack 15*a*. The underside of the rail 6 has an opening 22 to accommodate the mount 7 when the seat 1 is assembled. Each pair of rollers 16 runs along grooves 23 on opposite sides of the opening 22. A slot 24 is sized to receive the rack 15*a* and teeth 15 which are able to engage and disengage with the follower teeth 14.

The rod 9 and spring 19 are housed within a chassis base panel 5*a* and the mount 7 is housed within a mount panel 7*a* (shown in FIG. 2). The rack 15*a* is housed within the rail 6. The follower 13, while attached to the mount 7, extends partly within the rail 6 when the follower teeth 14 engage the rack teeth 15. The rollers 16 are housed within the rail 6 along the grooves. The mechanism of the adjuster 4 is therefore substantially enclosed when the seat 1 is assembled. This assists in protecting the adjuster parts from any dirt, moisture, spillage of bodily fluids and/or other contaminants that can damage exposed parts. It also assists in mitigating the risk of a user's fingers being accidentally caught in moving parts when the incline of the seat 1 is being adjusted.

Clause 1—A seat having a backrest, a base for receiving a posterior of a human user, and an incline adjuster having a shaft, a lever, a follower, and a rack, the shaft being moveable to swing the lever to cause a follower into or out of locking engagement with the rack, an arrangement being such that when the follower is in an unlocked disposition the rack can move to adjust an incline of the backrest and the base.

Clause 2—The seat according to clause 1, wherein the incline adjuster is a first incline adjuster, the seat further having a second incline adjuster, wherein the first incline adjuster is at a first side of the seat and the second incline adjuster is at a second side of the seat, the first side of the seat being substantially opposite to the second side of the seat, wherein the first and second incline adjusters are linked so that moving force transfers from one to the other such that the first and second incline adjusters move in unison.

Clause 3—A seat according to clauses 1 or 2, having a chassis base and a tilt rail, the chassis base and the tilt rail being connected by a link such that the tilt rail can be moved forwards and backwards with respect to the chassis base by way of rollers.

Clause 4—A seat according to clauses 1-4, wherein the lever pivots on the link.

Clause 5—A seat according to clause 4, having a second lever, wherein the second lever pivots on the link, such that the second lever assists movement of the follower with respect to the rack.

Clause 6—A seat according to clauses 3-5, wherein the tilt rail has at least one track which receives the rollers.

Clause 7—A seat according to clauses 3-6, wherein the tilt rail is curved.

Clause 8—A seat according to any one of the preceding clauses, wherein the rack is curved.

Clause 9—A seat according to clauses 1-8, wherein the follower has teeth which are adapted to engage complementary teeth of the rack in locking engagement.

Clause 10—A seat according to clauses 1-9, wherein the follower extends into an aperture in the tilt rail when the follower is in locking engagement with the rack.

Clause 11—A seat according to clauses 1-10, wherein the follower does not extend into the aperture in the tilt rail when the follower is out of locking engagement with the rack so that the rollers are able to move along the track.

Clause 12—A seat according to clauses 1-11, wherein a spring is able to be compressed to hold the follower out of locking engagement with the rack.

Clause 13—A seat according to clause 12, wherein pressure on the spring is able to be released to move the follower into locking engagement with the rack.

Clause 14—A seat according to clauses 1-12, wherein the shaft, the follower, and the rack are substantially enclosed.

Clause 15—A seat according to clauses 1-14, wherein movement of the shaft is activated by a foot pedal.

Clause 16—A seat having a backrest, a base for receiving the posterior of a human user, an incline adjuster, and a support the inclined adjuster being adapted to adjust an incline of the backrest and the base with respect to the support wherein the incline adjuster is substantially enclosed within at least one housing.

Non-limiting embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the present teaching, it is now claimed:

1. A seat comprising:

a backrest;

a base for receiving a posterior of a human user; and an incline adjuster comprising:

a shaft;

a lever;

a follower; and a curved rack the shaft being moveable to swing the lever to cause a follower into or out of locking engagement with the rack, an arrangement being such that when the follower is in an unlocked disposition the rack can move to adjust an incline of the backrest and the base.

2. The seat according to claim 1, wherein the incline adjuster is a first incline adjuster, the seat further comprising:

a second incline adjuster, wherein the first incline adjuster is at a first side of the seat and the second incline adjuster is at a second side of the seat, the first side of the seat being substantially opposite to the second side of the seat, wherein the first and second incline adjusters are linked so that moving force transfers from one to the other such that the first and second incline adjusters move in unison.

3. The seat according to claim 1 further comprising:

a chassis base; and a tilt rail, the chassis base and the tilt rail being connected by a link such that the tilt rail can be moved forwards and backwards with respect to the chassis base by way of rollers.

4. The seat according to claim 3, wherein the lever pivots on the link.

5. The seat according to claim 4, further comprising:

a second lever, wherein the second lever pivots on the link, such that the second lever assists movement of the follower with respect to the rack.

6. The seat according to claim 3, wherein the tilt rail has at least one track which receives the rollers.

7. The seat according to claim 3, wherein the tilt rail is curved.

8. The seat according to claim 3, wherein the follower extends into an aperture in the tilt rail when the follower is in locking engagement with the rack.

9. The seat according to claim 8, wherein the follower does not extend into the aperture in the tilt rail when the follower is out of locking engagement with the rack so that the rollers are able to move along the track.

10. The seat according to claim 1, wherein the follower has teeth which are adapted to engage complementary teeth of the rack in a locking engagement.

11. The seat according to claim 1, wherein movement of the shaft is activated by a foot pedal.

12. A seat comprising:

a backrest;

a base for receiving a posterior of a human user; and an incline adjuster comprising:

a shaft;

a lever;

a follower; and a rack, the shaft being moveable to swing the lever to cause a follower into or out of locking engagement with the rack, an arrangement being such that when the follower is in an unlocked disposition the rack can move to adjust an incline of the backrest and the base, wherein a spring is able to be compressed to hold the follower out of locking engagement with the rack.

13. A seat according to claim 12, wherein pressure on the spring is able to be released to move the follower into locking engagement with the rack.

14. A seat comprising:

a backrest;

a base for receiving a posterior of a human user; and an incline adjuster comprising:

a shaft;

a lever;

a follower; and a rack, the shaft being moveable to swing the lever to cause a follower into or out of locking engagement with the rack, an arrangement being such that when the follower is in an unlocked disposition the rack can move to adjust an incline of the backrest and the base, wherein the shaft, the follower, and the rack are substantially enclosed.

* * * * *